United States Patent [19]

Simon

[11] Patent Number: 4,743,882

[45] Date of Patent: May 10, 1988

[54] ROTARY POTENTIOMETER SENSOR FOR DETECTING THE ANGULAR POSITION OR MOVEMENT OF A ROTARY SHAFT

[76] Inventor: Jean-Fernand Simon, 6 Rue Claude Matrat, 92130 Issy Les Moulineaux, France

[21] Appl. No.: 40,106

[22] Filed: Apr. 20, 1987

[30] Foreign Application Priority Data

Apr. 25, 1986 [FR] France ..... 86 06049

[51] Int. Cl.[4] ..... H01C 1/02

[52] U.S. Cl. ..... 338/184; 338/162

[58] Field of Search ..... 338/162, 163, 164, 174, 338/184, 199; 123/494; 73/118.1

[56] References Cited

U.S. PATENT DOCUMENTS 4,355,293 10/1982 Driscoll ..... 338/162
4,430,634 2/1984 Hufford et al. ..... 338/162
4,616,504 10/1986 Overcash et al. ..... 338/184 X
4,621,250 11/1986 Echasseriau et al. ..... 338/162

FOREIGN PATENT DOCUMENTS 3042515 11/1980 Fed. Rep. of Germany .
0185443 9/1985 Fed. Rep. of Germany .

*Primary Examiner*—C. L. Albritton

*Attorney, Agent, or Firm*—Vorys, Sater, Seymour & Pease

[57] ABSTRACT

A rotary potentiometer sensor is provided for detecting the angular position or movement of a rotary shaft, which includes, a joint of the Oldham type with, on the one hand, three rotary parts, namely a first part carried and driven in rotation by the shaft, a second part adapted for rotating inside the sensor of which it forms the rotary part and a third part, called intermediate part, disposed between the first and second parts and, on the other hand, means provided on these three parts for providing the homocinetic rotational drive of the intermediate part by the first part and of the second part by the intermediate part, while allowing free angular movement; and a case of a general cylindrical shape containing said rotating shaft and the three rotating parts of said joint, this case having two lateral faces one of which is completely closed by a cover integral with the case and the other of which has passing therethrough a circular tube integral with the case and whose internal bore receives the first part which covers the free end of said shaft and whose peripheral surface is surrounded by the second part and the intermediate part.

10 Claims, 2 Drawing Sheets

ROTARY POTENTIOMETER SENSOR FOR DETECTING THE ANGULAR POSITION OR MOVEMENT OF A ROTARY SHAFT

BACKGROUND OF THE INVENTION

The present invention relates to rotary potentiometer sensors for detecting the angular position or movement of a rotary shaft.

Such sensors are frequently used in industrial devices and apparatus, in particular in motor vehicles, for determining the position or the movement of a rotary shaft, particularly in order to recopy this position or this movement remotely.

The accuracy of the indication supplied by a potentiometric sensor concerning the angular position or movemement of a rotary shaft is generally limited by the concentricity error between this shaft and the sensor. In fact, between the rotary part or rotor of the sensor and the shaft whose position or movement it is desired to know a homocinetic joint must be provided, which is disadvantageous in requiring space, complicating the assembly between the shaft and the sensor and exposes this joint to dust and different projections, particularly in the case where the potentiometric sensor is disposed under the bonnet of a motor vehicle, whence premature wear; thought has been given to protecting the joint, but this requires additional parts which increase the cost and space required.

SUMMARY OF THE INVENTION

The aim of the present invention is to overcome the above drawbacks by disposing the joint between the shaft, whose position or movement it is desired to know, and the rotary part of the sensor, about the free end of said shaft, which reduces the space required while housing said end of the shaft and the rotary joint itself inside the case of the sensor, which protects the joint without additional cost.

In its application to motor vehicles, the sensor of the invention in particular allows a very high angular precision to be obtained, for example less than 1°, without precision meaning and without requiring costly additional parts.

More precisely, the invention provides a rotary potentiometer sensor for detecting the angular position or movement of a rotary shaft, which includes, for the homocinetic transmission of the rotation of said shaft to the rotary part or rotor of the sensor, a joint of the Oldham type with, on the one hand, three rotary parts, namely a first part carried and driven in rotation by said shaft, a second part adapted for rotating inside the sensor of which it forms the rotary part or rotor and a third part, called intermediate part, disposed between the first and second parts and, on the other hand, means provided on these three parts for providing the homocinetic rotational drive of the intermediate part by the first part and of the second part by the intermediate part, while still allowing free angular movement between the axis of said shaft and the axis of the rotating part or rotor of the sensor, which sensor is characterized in that it includes a case of a general cylindrical shape containing the free end of said rotating shaft and the three rotating parts of said joint, this case having two lateral faces one of which is completely closed by a cover integral with the case and the other of which has passing therethrough a circular tube integral with the case and whose internal bore receives, with a clearance at least equal to the maximum error of concentricity which may be reasonably envisaged, said first rotating part which covers said free end of said shaft and whose peripheral surface is surrounded, with said clearance, by said second rotating part and said intermediate rotating part.

Advantageously:

the first rotating part includes a tubular portion which surrounds the free end of the rotating shaft and which may rotate with an easy fit inside said circular tube;

the second rotating part includes a tubular portion, which may rotate with an easy fit about said circular tube, and a brush holding element, whose brushes brush against a conducting track disposed on a part of the internal lateral surface of the case;

the cover of the case carries the connector of the sensor;

the case includes, on the same side as the lateral face which carries said circular tube, a circular collar concentric with said tube and disposed outside and at a distance therefrom, this collar serving for centering the case in a bore through which said shaft passes;

the intermediate part is a flat circular ring, whereas said first and second rotating parts include flat circular rings and the means for the homocinetic rotational drive of the three rotating parts, with the possibility of free angular movement, are formed by four radial slots provided on the periphery of the intermediate part, each at 90° from the preceding one in the peripheral direction, and by two pairs of studs carried by the flat circular ring of respectively said first and said second rotating parts on their face directed towards the intermediate part, the two studs of the same pair being diametrically opposite and the straight line joining the centers of the two studs of the pair of the first rotating part being orthogonal to the straight line joining the centers of the two studs of the pair of the second rotating part;

the first rotating part has a central protuberance against its face which is directed in the direction of the cover of the case;

the free end of the rotating shaft includes a flat portion which cooperates with a flat portion which forms inwardly a part of the tubular portion of the first rotating part To ensure efficient cooperation between the three rotating parts, there may be provided:

in a first embodiment, a helical recall spring disposed, inside the case, between the internal surface of the lateral face of the case bearing said circular tube and the second rotating part for applying this second part against the intermediate part, this intermediate part against the first rotating part and this first part against the cover of the case;

in a second embodiment, tongues forming an integral part of the intermediate part, and holding said pairs of studs in contact each with the opposite face of the intermediate part.

BRIEF DESCRIPTION OF THE DRAWINGS

The invention will in any case by well understood from the complement of description which folllows, as well as from the accompanying drawings, which complement and drawings are of course given solely by way of indication.

DESCRIPTION OF THE PREFERRED EMBODIMENTS

Figure 1:
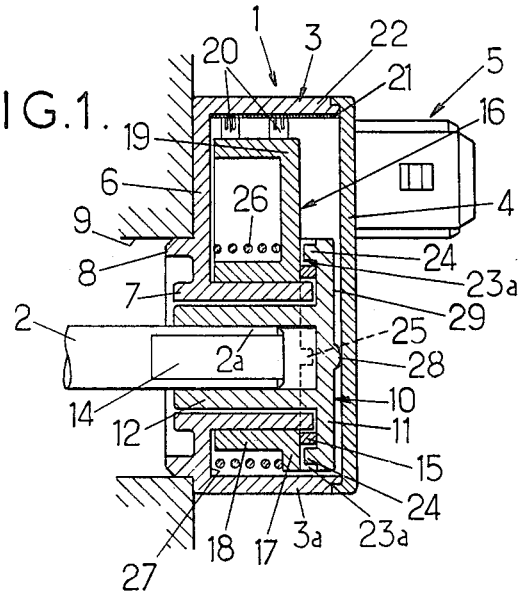
FIG. 1 is a sectional view of a rotary potentiometric sensor, showing the arrangements in accordance with the invention.
Figure 2:
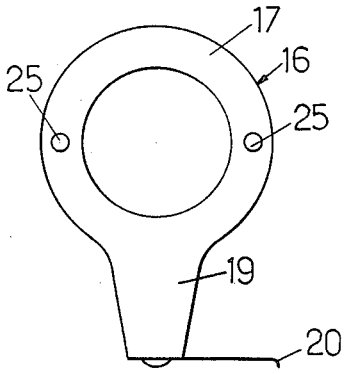
FIGS. 2, 3 and 4 show the three rotating parts of the Oldham type joint which this sensor comprises, namely respectively said second part, said intermediate part, and said first part.
Figure 3:
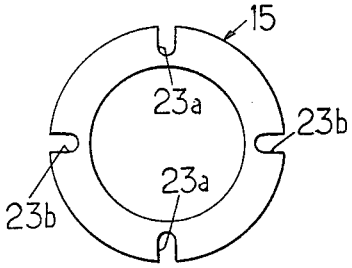
Figure 4:
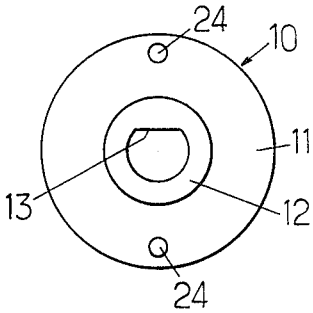
Figure 5:
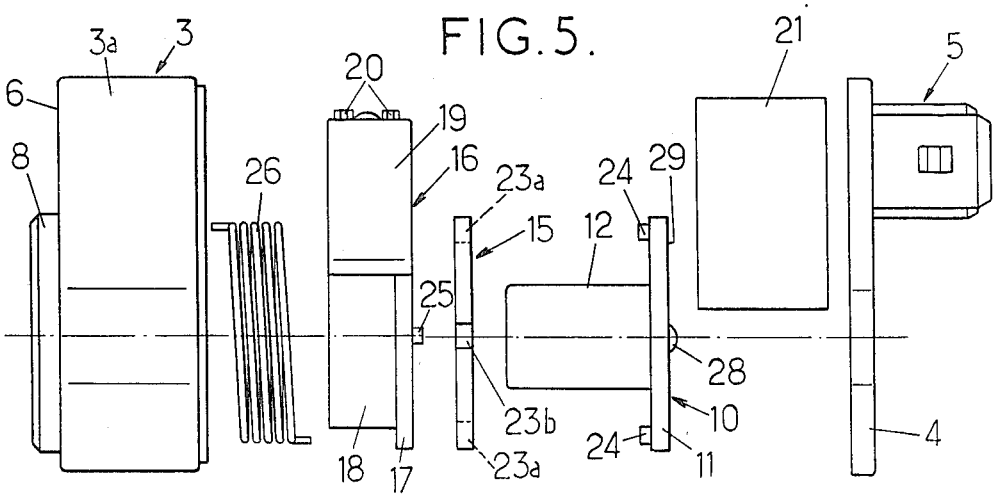
FIG. 5 is an exploded view of the sensor of FIG. 1.

According to the invention, and more especially according to that one of its modes of its application to which it seems preference should be given, wishing to construct a rotary potentiometer sensor for protecting the position or movement or a rotary shaft, the following or similar is how to set about it.

A sensor 1 in accordance with the invention, intended for detecting the position or movement of a rotary shaft, 2, includes first of all a case 3 of a general cylindrical shape one of whose faces is closed by a cover 4 which is welded, crimped or bonded to the body 3*a* of the case, this cover 4 carrying the connector 5 of the sensor, and whose other lateral face 6, which forms an integral part of the body 3*a* of the case, carries a circular tube 7 which is surrounded by a circular collar 8 concentric with tube 7 and disposed inside this latter and at a distance therefrom, this collar 7 serving for centering case 3 in a bore 9 through which shaft 2 passes.

A first rotating part 10, which is a driving part, is secured for rotation with shaft 2. This rotating part 10 includes a flat circular ring 11 and a tubular centering ring 12 which may rotate, with a clearance at least equal to the maximum error of concentricity which may be reasonably envisaged, in the circular tube 7. The rotational drive by shaft 2 of the rotating part 10 is ensured for example by providing inside the centering ring 12 a flat portion 13 which cooperates with a coresponding flat portion 14 formed on the free end 2*a* of shaft 2.

The rotating part 10 forms the first element of an Oldham joint which includes two other rotating parts, namely an intermediate part, 15 formed by a flat circular ring and a second rotating part 16, which is a driven part, forms the rotor or rotating part of the sensor Part 16 includes a flat circular ring 17 which has, on the one hand, a tubular portion 18 which may rotate with an easy fit about the circular tube 7 and, on the other hand, a brush holding element 19 whose brushes 20 rub against a conducting track 21 disposed on a part 22 of the internal lateral surface of case 3.

The rotational interlock between the three elements 10, 15 and 16 of the Oldham joint, while allowing free angular movement between the axis of shaft 2 and the axis of the rotating part or rotor of the sensor is provided in the following way:

the intermediate part, 15 has two slots 23*a* and two slots 23*b* each disposed at 90° from the preceding one, in the peripheral direction, the two slots 23*a*, on the one hand, and 23*b*, on the other, being diametrically opposite;

the first rotating part 10 has two diametrically opposite studs 24 carried on the face of the flat circular ring 11 of this part 10 which is turned towards the intermediate part 15, these studs 24 penetrating into the slots 23 in the intermediate part, 15; and the second rotating part 16 has two diametrically opposite studs 25 carried by the face of the flat circular ring 17 of this part 16 which is turned towards the intermediate part 15, these studs 25 penetrating into the slots 23*b* in this part 15.

A helical return spring 26 is disposed, inside case 3, between the internal surface 27 of the lateral face 6 of the case carrying the pipe 7 and the ring 17 of the second rotating part 15 for taking up the rotational play between parts 2, 10, 15 and 16 while exerting a return torque which ensures, when stopped or during rotation of shaft 2 the application of the flat portion 14 of the rotary shaft, 2 on the internal flat portion 13 of the first rotating part 10, studs 24 in the slots 23*a* of the intermediate part 15, and slots 23*b* on the studs 25 of the second rotating part 6.

A central protuberance 28, carried by the face 29 of the circular ring 11 which is facing the cover 4, provides the contact, with possibility of free movement, between the circular ring 11 of the first rotating part 10 and cover 4 while reducing the friction.

The operation of the potentiometric sensor of the invention is the following.

The rotation of shaft 2 causes, through the flat surfaces 13 and 14 rotation of the first rotating part 10 whose studs 24, cooperating with the slots 23*a* in the intermediate part 15, drive this latter in rotation, whereas cooperation between the studs 25 of the second rotating part 16 and slots 23*b* cause the rotational drive of the second rotating part 16. Thus, rotation of shaft 2 causes the second rotating part 16 and so the brush holder 19 to be driven in rotation homocinetically, the brushes 20 of the brush holder 19 moving over the fixed conducting track 21 carried by case 3.

In a way known per se, the position of brushes 20 on the conducting track 21 is processed in the connector of the sensor and is used as is desired, particularly for remote recopying of the position or the movement of the rotary shaft, 2.

Figure 6:
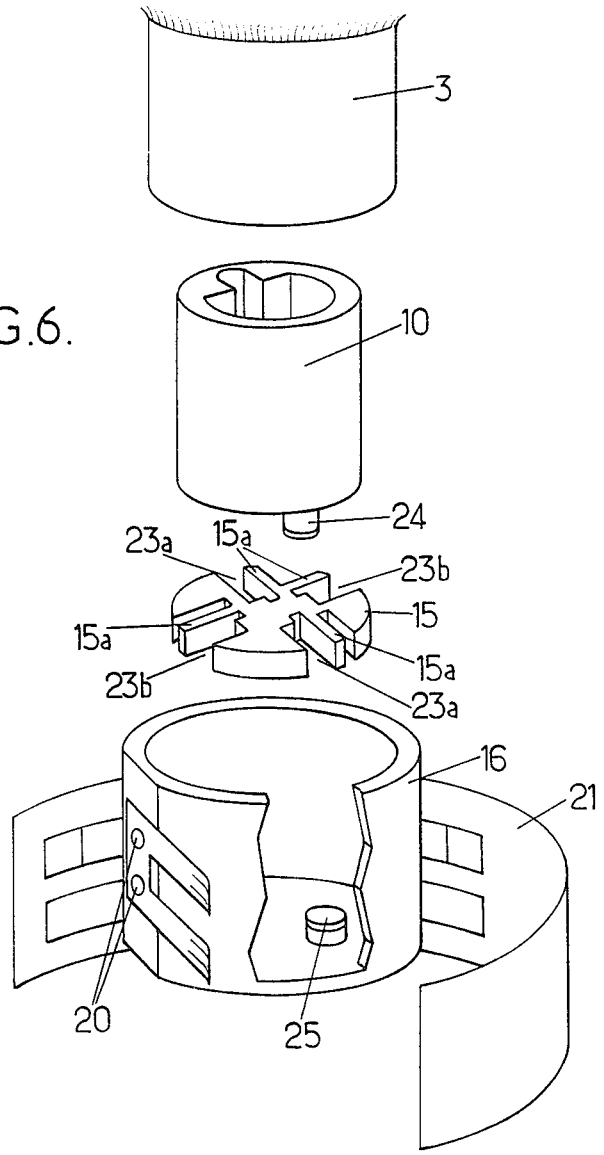
FIG. 6, finally, illustrates a variant of the sensor in a partial exploded view.

In a variant illustrated in FIG. 6 (in which we find again case 3 and the three rotating parts 10, 15 and 16, as well as studs 24 of part 10 and 25 of part 16, and slots 23*a*, 23*b* of part 15), the spring 26 of the embodiment shown in FIGS. 1 to 5 has been replaced by four tongues 15*a* forming an integral portion of the intermediate part, 15 and which holds studs 24 and 25 in contact with the facing face of this part 15.

Thus, in accordance with the invention and particularly according to the two embodiments (FIGS. 1–5 and FIG. 6) particularly described—a compact sensor is obtained, well protected from dust and which allows a very high accuracy to be obtained in sensing the position or movement of a rotary shaft, for example an accuracy less than 1°.

As is evident and as it follows moreover already from what has gone before, the invention is in no wise limited to those of its modes of application and embodiments which have been more especially considered; it embraces, on the contrary, all variants thereof.

What is claimed is:

1. A rotary potentiometer sensor for detecting the position or movement of a rotary shaft, which includes, for the homocinetic transmission of the rotation of said shaft to the rotary part or rotor of the sensor a joint of the Oldham type with, on the one hand, three rotary parts, namely a first part carried and driven in rotation by said shaft, a second part adapted for rotating inside the sensor of which it forms the rotary part or rotor and a third part, called intermediate part, disposed between the first and second parts and, on the other hand, means provided on these three parts for providing the homocinetic rotational drive of the intermediate part by the first part and of the second part by the intermediate part, while allowing free angular movement between the axis of said shaft and the axis of the rotating part or rotor of the sensor, wherein it includes a case of a general cylindrical shape containing said rotating shaft and the three rotating parts of said joint, this case having two lateral faces one of which is completely closed by a cover integral with the case and the other of which has passing therethrough a circular tube integral with the case and whose internal bore receives, with a clearance at least equal to the maximum error of concentricity which may be reasonably envisaged, said first rotating part which covers the free end of the said shaft and whose peripheral surface is surrounded, with said clearance, by said second rotating part and said intermediate rotating part.

2. Sensor according to claim 1, wherein the first rotating part has a tubular portion which surrounds the free end of the rotary shaft, and which may rotate, with said play, inside said circular tube.

3. Sensor according to claim 1, wherein the second rotating part includes a tubular portion which may rotate with an easy fit about said circular tube, and a brush holding element whose brushes rub against a conducting track disposed on a part of the internal lateral surface of the case

4. Sensor according to claim 1, wherein the cover of the case carries the connector of the sensor

5. Sensor according to claim 1, wherein the case has, on the same side as the lateral face which carries said circular tube a circular collar concentric to said tube and disposed outside and at a distance there from, this collar serving for centering the case in a bore through which said shaft passes.

6. Sensor according to claim 1, wherein the intermediate part is a flat circular ring, whereas said first and second rotating parts include flat circular rings and means for the homocinetic rotaional drive of the three rotatomg parts, with the possibility of free angular movement, are formed by four radial slots provided on the periphery of the intermediate part, each at 90° from the preceding one in the peripheral direction, and by two pairs of studs carried by the flat circular rings of respectively said first and said second rotating parts on their face directed towards the intermediate part, the two studs of the same pair being diametrically opposite and the straight line joining the centers of the two studs of the pair of the first rotating part being orthogonal to the straight line joining the centers of the two studs of the pair of the second rotating part;

7. Sensor according to claim 1, wherein the first rotating part has a central protuberance against its face which is directed in the direction of the cover of the case.

8. Sensor according to claim 1, wherein the free end of the rotating shaft includes a flat portion which cooperates with a flat portion formed inside the tubular portion of the first rotating part.

9. Sensor according to claim 1, wherein a helical recall spring disposed, inside the case between the internal surface of the lateral face of the case bearing said circular tube and the second rotating part for applying this second part against the intermediate part this intermediate part against the first rotating part and this first part against the cover of the case, so as to ensure efficient cooperation of the three rotating parts.

10. Sensor according to claim 1, wherein the intermediate part has tongues forming an integral part thereof and holding said pairs of studs in contact each with the opposite face of the intermediate part.

* * * * *